United States Patent [19]

Maopolski

[11] 4,034,974

[45] July 12, 1977

[54] COLLATING SYSTEM

[75] Inventor: Bernard John Maopolski, Easton, Pa.

[73] Assignee: Harris Corporation, Cleveland, Ohio

[21] Appl. No.: 668,232

[22] Filed: Mar. 18, 1976

Related U.S. Application Data

[63] Continuation of Ser. No. 448,821, March 7, 1974, abandoned.

[51] Int. Cl.[2] ..... B65H 5/30

[52] U.S. Cl. ..... 270/55; 270/18

[58] Field of Search ..... 270/1–22, 270/32, 53, 39–52, 54–58; 271/64, 3.1, 179, 172, 184, 225

[56] References Cited

U.S. PATENT DOCUMENTS

| | | | |
|---|---|---|---|
| 3,467,371 | 9/1969 | Britt | 270/58 |
| 3,522,943 | 8/1970 | Swanson | 271/3.1 X |
| 3,612,249 | 10/1971 | Schneider | 271/184 |
| 3,623,722 | 11/1971 | Sjogren | 271/64 |
| 3,825,246 | 7/1974 | Elia | 270/54 |

*Primary Examiner*—Edgar S. Burr
*Assistant Examiner*—A. Heinz

[57] ABSTRACT

A combined system of printing presses and a plurality of collators. Each of the collators assembles a freshly printed signature from the printing press with at least one preprinted signature. Each collator includes a plurality of hoppers for receiving signatures and means for feeding the signatures individually from the hoppers and for collating the signatures fed from the hoppers. A conveying system is provided for selectively either directing a stream of signatures from each of the respective printing presses to one respective hopper of each of the collators or directing a stream of signatures from either press to both of the one hoppers of both collators.

4 Claims, 6 Drawing Figures

COLLATING SYSTEM

This is a continuation of application Ser. No. 448,821 filed Mar. 7, 1974, now abandoned.

BACKGROUND OF THE INVENTION

The present invention is directed to a system for handling a plurality of printing press signature outputs and for collating signatures which are freshly printed by the printing presses with preprinted signatures.

Collators for collating signatures are well known and in general such collators include a plurality of hoppers and means for feeding signatures individually from the hoppers and into pockets or the like in a conveyor system which moves past the hoppers. Typical collaratos are shown in U.S. Pat. No. 2,634,971.

In addition, it has been suggested in copending application of Bryson et al, Ser. No. 227,184, filed Feb. 17, 1972, now U.S. Pat. No. 3,881,716 and assigned to the assignee of the present invention, that the output of a printing press can be fed directly into a particular hopper of a collating machine (which may be termed an "on-line" hopper) and then when the output is fed from the hopper, it is collated with preprinted signatures. When the one on-line hopper is filled, signatures may be fed beyond that hopper and directed into another on-line hopper of another collator.

SUMMARY OF THE PRESENT INVENTION

The present invention is directed to a system in which a plurality of printing presses are associated with a plurality of stuffers providing a highly flexible system capable of different modes of operation. In fact, the system provides for either one of plural press outputs to be directed into an on-line hopper of two different stuffers. Also, the output of either press may be directed into both hoppers of either stuffer. This flexibility provides a highly improved system where, if one stuffer is inoperative, both presses could still feed the other stuffer, or, if one press is operative, both stuffers can receive the output of the other press.

Further features and advantages of the present invention will be apparent to those skilled in the art from the following detailed description of embodiments thereof made with reference to the accompanying drawings in which.

DESCRIPTION OF THE EMBODIMENTS

As noted hereinabove, the present invention is directed to a combined system which includes a plurality of printing presses and a plurality of collators. The specific structure of the collators may vary in the system, as well as the specific structure of the printing press. The present invention is generally directed to a manner of arranging the collators and printing presses so that the output of the presses can be conveyed into on-line hoppers in each of the collators. In fact, the system is such that a wide flexibility of modes of operation and conveyance of the signatures can be effected.

Figure 1:
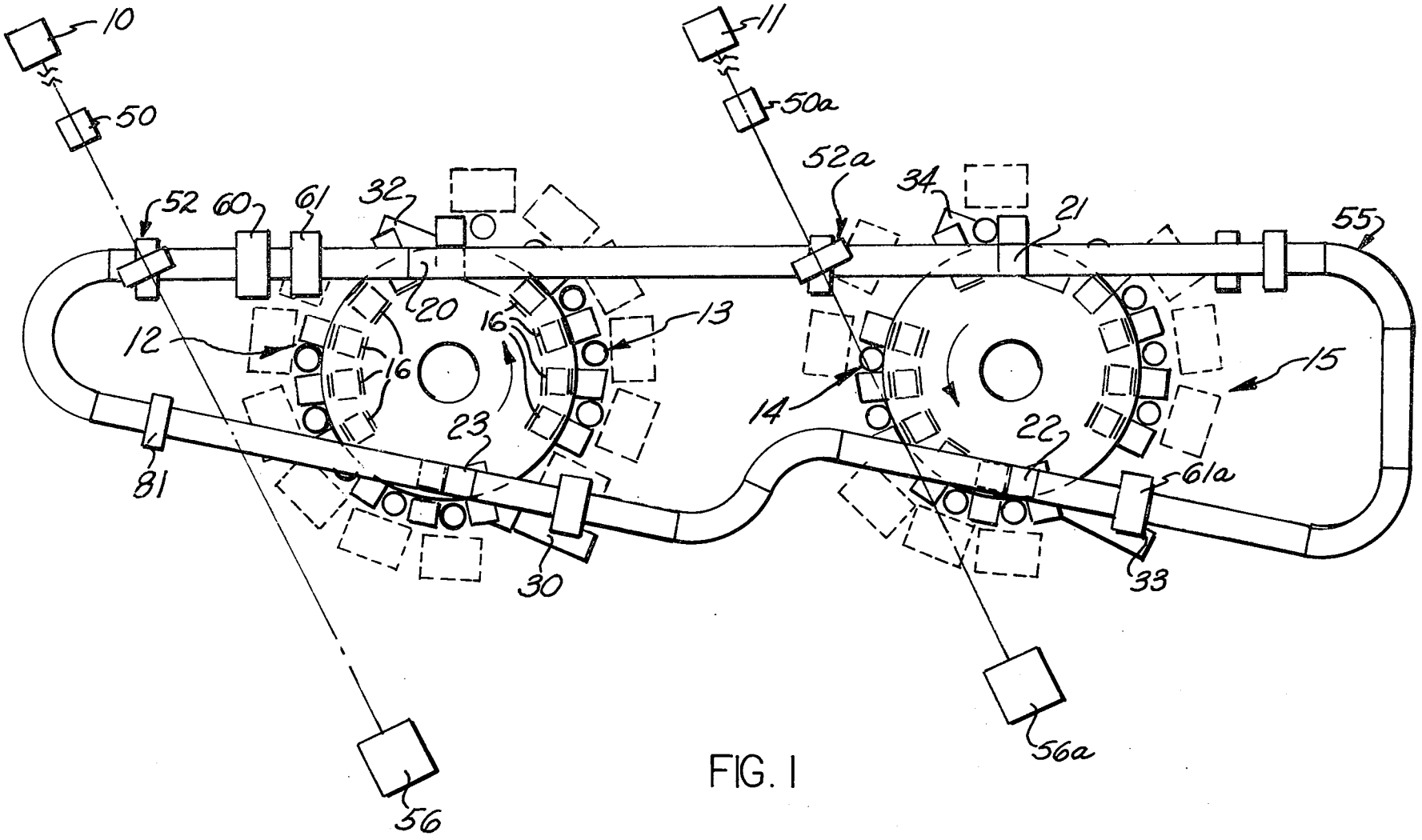
FIG. 1 is a schematic view of a system embodying the present invention.

As shown schematically in FIG. 1, a pair of printing presses 10, 11 may provide a freshly printed newspaper section for four different newspaper stuffers, designated 12–15. At each of the newspaper stuffers 12–15, the freshly printed product conveyed directly from the printing presses 10, 11, as will be described hereinbelow, is combined with previously printed inserts of newspaper sections to form a completed newspaper.

The stuffers 12, 13 in the preferred embodiment comprise two 180° sectors of a rotary stuffer of the type shown in U.S. Pat. No. 2,634,971, granted to Schweizer on Apr. 14, 1953. The stuffers 14, 15 likewise comprise two 180° sectors of a rotary stuffer of the type shown in U.S. Pat. No. 2,634,971. Since such stuffers are well known in the art, a detailed description thereof will not be made herein.

It should be understood, however, that the suffers 12, 13 are provided with a series of hoppers 16, each of which is filled either by an operator standing at the outer periphery of the rotary stuffer, as is common, or by a suitable feeding mechanism. The hoppers, whether fed by a feeding mechanism or hand fed, are filled with preprinted newspaper sections for collation with the freshly printed newspaper section which is delivered directly either from the press 10 or 11 to the stuffer. Each of the stuffers 12–15 is provided with a hopper which may be automatically filled by the freshly printed product from the printing presses 10, 11. For this purpose, the stuffer 12 has an on-line hopper 20 into which freshly printed newspaper sections may be delivered directly from the press. Such hopper is designated 21 for stuffer 14. The on-line hopper for stuffer 15 is designated 22, and the on-line hopper for stuffer 13 is designated 23.

While the stuffers are, as noted above, 180° sectors of a rotary stuffer of the type shown in U.S. Pat. No. 2,634,971, and thus well known in the art, it should be understood that each of the hoppers of each stuffer, including the hoppers 20–23 to which the press deliveries 10, 11 are directly fed, have associated with them a feed mechanism for individually feeding signatures from the hopper. This feeding mechanism is commonly known as a bottom feed. Also, the stuffer includes a conveyor mechanism which includes a plurality of individual pockets, which pockets travel counterclockwise, as viewed in FIG. 1. As an individual pocket passes a hopper, a newspaper section is fed into the pocket and thereby collated with previous sections that have been fed into that pocket. The on-line hoppers are the first hoppers in each collator and the jackets or outside section of the newspaper fed therefrom, that being the last section to be printed.

The completed newspapers are delivered from the stuffers by dropping the completed newspaper from the pocket at a delivery location, as is conventional. As shown schematically in FIG. 1, the delivery from the stuffer 12 is designated 30, while the delivery from stuffer 13 is designated 32. The delivery 32 comprises conveyors which extend over the stuffer 12. These deliveries may be combined into a common delivery for conveying the completed newspapers from the stuffer. The delivery conveyor system for the stuffer 14 is designated 33, and the delivery for the stuffer 15 is designated 34. These deliveries will not be described in detail, since any delivery may be used.

The direct feeding of printed newspaper sections into a hopper of a stuffer is known and is disclosed in copending application Ser. No. 227,184, filed Feb. 17, 1972, and assigned to the assignee of the present invention. While that particular application discloses the structure and apparatus for handling signatures directly from a printing press, it does not disclose the present invention, as described hereinbelow.

Newspaper printing presses and newspaper stuffers are both relatively high-priced pieces of equipment. In addition, they are expensive to operate because of the highly skilled labor required to make them perform properly. For greatest efficiency, their downtime, i.e., time during which they are stopped during preparation for operation or correction of malfunction, should be kept to a minimal. A typical problem in on-line equipment, as disclosed in the present application, is that machine stoppage due to malfunction in one section of the line causes the entire line to be shut down.

The present invention contemplates the use of either the printing press 10 or 11 with any or all of the stuffers 12–15. In fact, the present invention is directed to a combined system in which the delivery or output of the press 10 may be fed directly to either one or all of the hoppers 20–23, or any combination thereof. Likewise, the system can be operated so that the output of the printing press 11 is directed to either one or all of the hoppers 20–23. Moreover, the system can be operated so that the output of press 10 is delivered to the hoppers 20, 21 while the output of the press 11 is delivered directly to the hoppers 22, 23. In fact, as will be apparent from the description hereinbelow, a substantial number of different combinations of press and stuffers can be utilized.

The presses 10, 11, of course, have associated with them and forming a part thereof, a suitable folder mechanism, etc., for producing folded signatures in an overlapped shingled stream. This disclosure refers to a printing press but includes a printing press and folder combination. The output of the press 10 is delivered through a stream pressure or squeeze roll assembly 50, shown schematically in FIG. 2.

Figure 3:
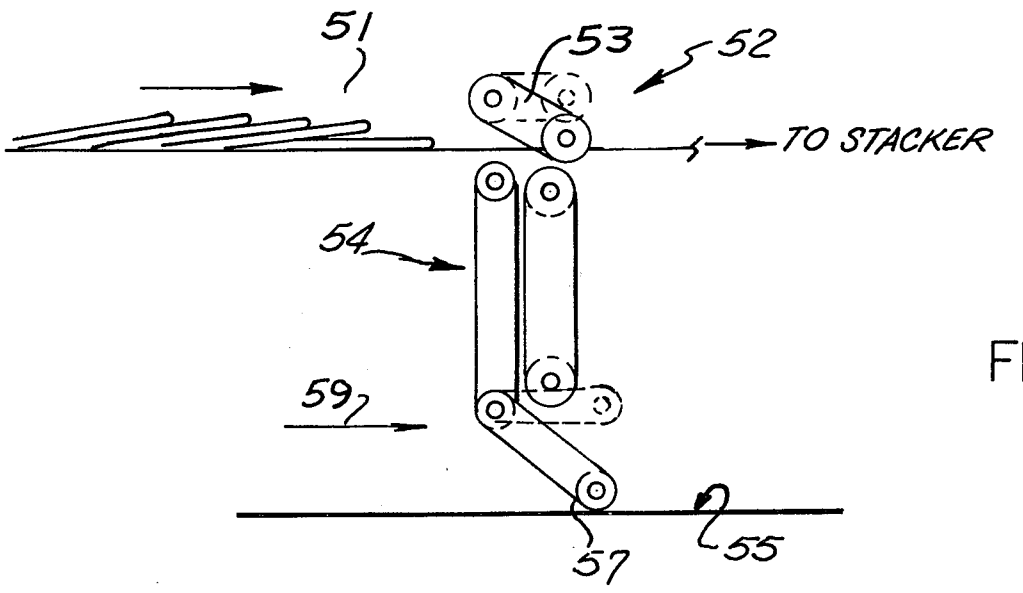
FIG. 3 is a schematic view of another portion of the system of FIG. 1.

As the stream advances toward the collators where the freshly printed signatures are to be combined or collated with previously printed signatures, the stream encounters a switch or directing mechanism, generally designated 52 (See FIG. 3). The stream switch or mechanism 52 may take any one of a variety of different constructions, but is illustrated as including a gate-type member 53 which, when in its full-line position, directs the stream of signatures 50 downwardly through a conveyor arrangement 54 and to a manifold conveyor 55 on a lower level. The directing member 53, when in its dotted-line position shown in FIG. 3, allows the signatures 51 to traverse beyond the member 53 in a straight direction and be directed directly to a stacker device 56. If, however, the member 53 is in its full-line position, the signatures are diverted downwardly and toward the conveyor 55.

At the lower end of the mechanism 54, there is also a diverting member 57 (FIG. 3) which is similar to the member 53. The member 57 is adjustable between two positions and when in its full-line position, the signatures which are diverted downwardly by the member 53 are then diverted horizontally into the conveyor 55 to travel in a horizontal direction, as will be described hereinbelow. However, if the member 57 is in its dotted position, this would allow for signatures on conveyor mechanism 55 which are coming toward the member 57, as indicated by the arrow 59, to traverse beyond the member 57 and continue along on conveyor 55, for reasons which will be discussed hereinbelow.

As the signatures traverse along conveyor 55, they encounter a stream aligner mechanism 60 which merely comprises a jogger mechanism which jogs the signatures and aligns the stream as it is being conveyed. The stream aligner mechanism 60 is located in advance of the hopper 20, into which the output of the printing press 10 is directed.

Figure 2:
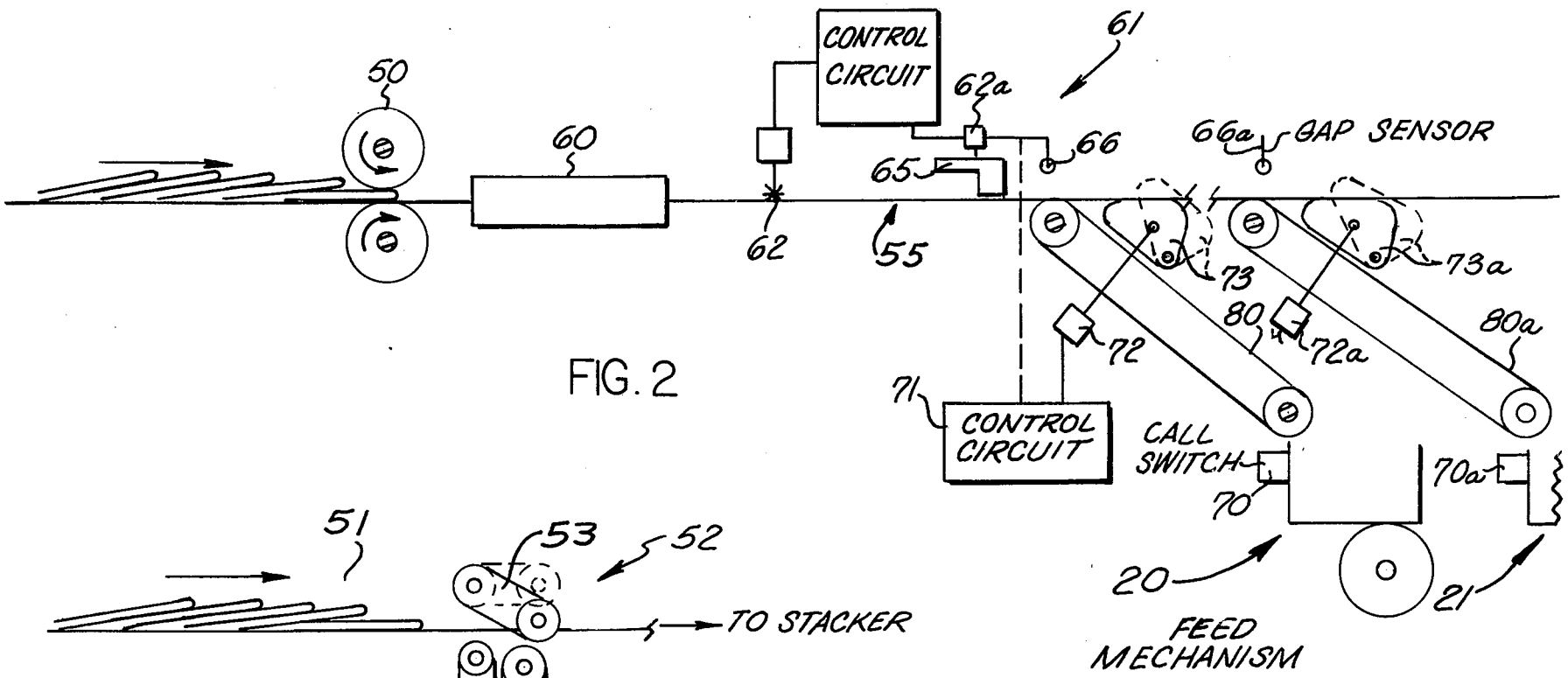
FIG. 2 is a schematic view of a portion of the system shown in FIG. 1.

Also, immediately in advance of the hopper 20 is gap-making mechanism, generally designated 61 (See FIG. 2). The gap-making mechanism 61 in general comprises a counter which includes a star wheel 62 which engages the noses or leading edges of the signatures as they are advanced along the conveyor 55. As the signatures are advanced and engage the nose of the counter 62, the signatures are counted. The counter is a well-known type of counting device and will not be described herein in detail. The output pulses of the electronic counter are fed into a control circuit and the control circuit in turn may be set to form the gap when a predetermined number of signatures have been conveyed past the counter. When the control circuit senses that a predetermined number of signatures has traversed past the counter 62, a solenoid **62*a* is actuated by the control circuit. The solenoid 62*a* in turn actuates a blocking or hook member 65 and moves that hook member downwardly into engagement with the signatures as they are being advanced along the conveyor. When the hook member 65 engages the signatures, it, of course, stops the advancing movement of the signatures, and as a result, the overlapping relationship between the signatures becomes more dense. The signature immediately in advance of the signature which was engaged by the hook member 65 continues to advance forward on the conveyor 55 and thus a gap is formed between the signature immediately in advance of the signature engaged by the hook 65 and the signature which is engaged by the hook 65**.

When the trailing edge of the signature immediately in advance of the signature that was engaged by the hook 65 passes an electric eye 66, the eye 66 senses the gap which has been formed. The particular spacing of the eye 66 from the hook 65 will determine the exact dimension of that gap and by properly adjusting that space a proper size gap may be provided. When the gap is sensed by the gap sensor 66, a signal is applied to the solenoid **62*a* and the solenoid 62*a* is triggered to raise the hook 65** and permit the signatures previously retained thereby to be advanced forwardly. Thus, of course, a gap is formed in the stream. This is only one method of forming the gap: other methods can be utilized.

As the signatures advance along the conveyor 55, the signatures may be diverted into the hopper 20. The hopper 20 is provided with a sensing switch 70 which senses the level of the signatures in the hopper and upon sensing that the level of the signatures in the hopper 20 has reached a predetermined minimal level, the switch applies a signal to the control circuit 71. When the control circuit 71 receives a signal from the switch 70, as well as from the gap sensor 66, it sends an output signal to a solenoid 72, which in turn flips a gate 73 from its full-line position shown in FIG. 2 to its dotted line position shown in FIG. 2. When the gate 73 was in its full-line position, the signatures which are being advanced along the conveyor 55 could traverse along the conveyor and beyond the gate 73 and would then be fed by the conveyor 55 toward the hopper 21. However, if the switch 70 senses the need for signatures in the hopper 20 and the control circuit is signalled by the gap sensor 66 as to the location of the gap, the gate 73 will be operated by the solenoid 72 to its dotted-line position when the gap in the signature stream is located adjacent the gate 73. Therefore, the gate 73 is thrown or moved into the gap in the signature stream. The gate 73 thereby gates or directs the signatures in the stream on the conveyor 55 downwardly along a driven conveyor mechansim 80 and directly into the hopper 20. Of course, the flow of signatures down the conveyor 80 and into the hopper 20 may or may not satisfy or cause the switch 70 to be actuated, indicating a proper number of signatures in the hopper. In the event that the switch 70 is not satisfied by the feeding of the batch of signatures which has been separated downwardly into the hopper 20, the switch 70 would merely call for additional signatures, and the next batch of signatures that is formed by the gap-maker would again be forwarded or conveyed by the conveyor 80 to the hopper 20. Once the hopper 20 has been satisfied, the gate member 73 will be moved from its dotted-line position to its full-line position and thus any additional batches of signatures which are formed by the gap-maker are traversed or passed beyond the gate or divert member 73 and toward and along the conveyor 55 toward the hopper 21 of the stuffer 14.

There is located at the hopper 21 a mechanism similar to that described above in connection with the hopper 20 for diverting the signatures in batches to the hopper 21 directly from the conveyor 55. This mechanism, of course, includes a divert gate or the like similar to the divert gate 73 and which is indicated to be 73*a* in FIG. 2. There is a similar divert mechanism, not shown in the drawings, at hopper 22 and at hopper 23, and the mainfold conveyor 55 extends around the various stuffers, and past each of the on-line hoppers, as shown in FIG. 1. It should be clear that the output of the press is formed by the gap-maker 61 into a plurality of batches of a predetermined count and that a gap sensor located along the conveyor 55 at each hopper 20, 21, 22, 23 will sense the gap, and if that particular hopper requires signatures, the divert gate associated with that hopper will be actuated and the signatures will be diverted into that particular hopper. Accordingly, it should be clear that in this mode of operation of the system the output of the press 10 may be delivered to all four hoppers in an on-line manner.

The system shown in FIG. 1 also provides for taking the output of the printing press 11 and for directing it to all of the hoppers 20, 21, 23, 23. The output of the press 11 likewise is conveyed through a squeeze roll arrangement, designated 50*a*. Also, the output of the press 11 traverses through a gate mechanism, generally designated 52*a*, which is similar to the mechanism shown in FIG. 3. With the divert member 53*a* of the gate mechanism 52*a* in the proper position, the output of the press 11 may be directed to a stacker 56*a* or fly table and completely bypass the stuffers 12–15. With the gate mechanism 52*a* set in a position where the member 53*a* is located in a position such as the dotted-line position in FIG. 4, and the gate member 57*a* in its full-line position, the signatures which are conveyed along the conveyor 55 from the hopper 20 will merely pass the member 57*a* and not be affected thereby. Of course, in this mode of operation of the system both presses could be operating and the output of the press 10 be directed into the collating system where the output of the press 11 is directed to the stacker 56*a*.

Figure 4:
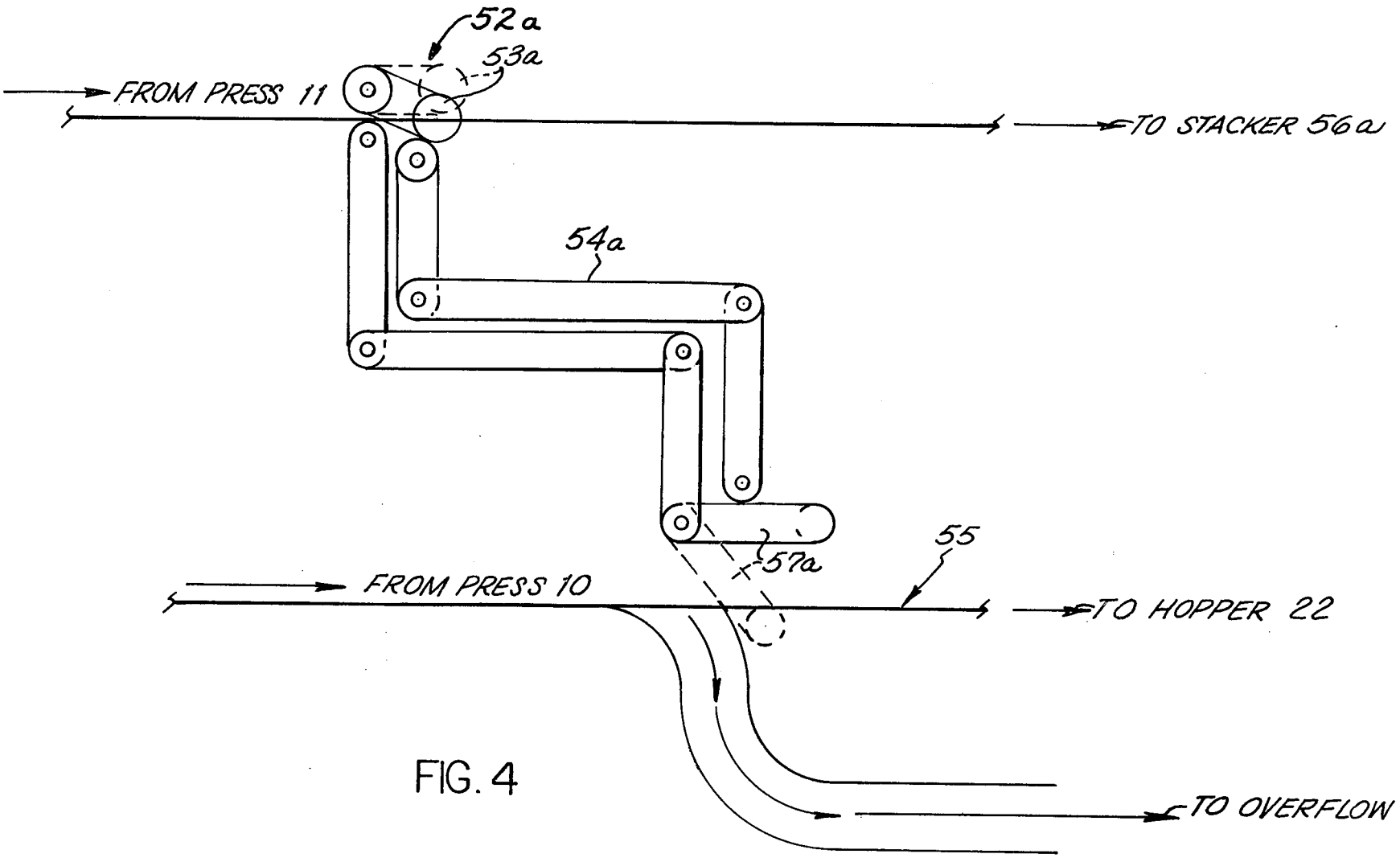
FIG. 4 is a schematic view of still another portion of the system of FIG. 1.

However, it is also possible to have the press 10 either operating to direct signatures to the stacker 56 or not operating, and the press 11 operating to direct the signatures into the stuffer system. In this case, the signatures are, as shown in FIG. 4, directed from the press 11 and onto the conveyor mechanism 55 through conveyor system 54*a*. As shown in FIG. 4, the gating member 53*a* would have to be located in its full-line position, and the gating member 57*a* would have to be located in its dotted-line position. The signatures are then conveyed or directed through the conveyor system 54*a* and to the conveyor 55. The conveyor mechanism 54*a*, as shown in the schematic layout in FIG. 1, has a horizontal portion which extends over the conveyor 55 and over the hopper 21 for some amount of distance, and the member 57*a* is located generally as indicated in dotted lines in FIG. 4. Thus, it should be clear that the output of the press 11 enters onto the conveyor 55 at a location between the hopper 21 and the hopper 22. The signatures from the press 11 are then conveyed by the conveyor system 55 past the gap-maker 61*a* similar to the gap-maker described above. The gap-maker 61*a* operates in precisely the same manner as the gap-maker 61 and the output of the press 11 thus may be delivered into the various hoppers in the stuffers and may be delivered first directly to the hopper 22. Once the hopper 22 is filled, it may be delivered into the hopper 23; once that is filled, the output may be delivered to the hopper 20; and once that is filled it may be delivered to the hopper 21, in much the same manner as described above in connection with the press 10. Accordingly, from the above, it should be clear that the output of either press 10 or 11 may be directed into any or all of the hoppers 20–23.

The present system is also constructed so that the output of both presses 10, 11 may be simultaneously directed into the stuffing system which includes the stuffers 12–14. This is accomplished by having the output of the press 10 traversed through the gap-maker 61 and therefore be directed into either the hopper 20 or 21 as those hoppers demand signatures. The output of the press 11 may be directed to the gap-maker 61*a* and the batches of signatures formed thereby may be directed into the hoppers 22 or 23, as the demand requires.

The overflow, if any, is directed out of the system and suitably stored. In this case, at the end of the conveyor section 55 between hoppers 21, 22, the gating mechanism, best shown in FIG. 4, provides for such overflow. If the member 57*a* is in its dotted-line position directing signatures from the press 11 onto the conveyor 55, it will likewise direct overflow from the press 10 downwardly to a suitable storage area where that overflow may be stacked. A suitable type of overflow provision may be provided at point 81 so that the overflow from the press 11 may be conveyed out of the conveyor system 55. Accordingly, it should be clear from the above that the output of either press 10 or 11 may be directed to all of the hoppers or the hopper 20, 21 may operate and receive the output of press 10, while the hopper 22, 23 may receive the output of press 11. Also, in the event that the system is set so that a given press, such as the press 11 delivers signatures to every one of the on-line hoppers 20–23, there still could be overflow from the system, in which case the gate 57a would be located in its dotted-line position and the overflow, which would then be from press 11, would be directed downwardly to the overflow, as shown in FIG. 4. Such overflow could also be created when press 10 delivers signatures to all of the hoppers and the overflow would be directed from the system 81.

Figure 5:
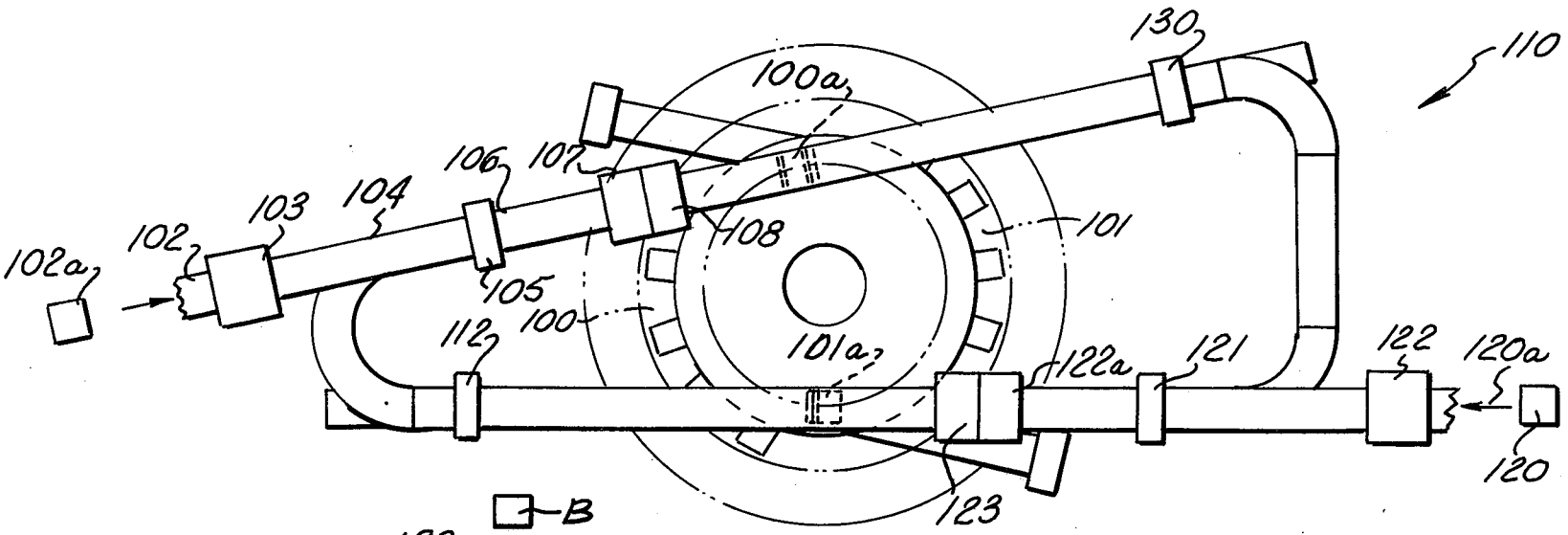
FIG. 5 is a schematic view of a modified embodiment of the present invention.

FIG. 5 illustrates how the present invention may be applied to a system which includes two stuffers 100, 101. The stuffers 100, 101, as in the embodiment of FIG. 1 comprise two 180° sectors of a rotary stuffer of the type shown in U.S. Pat. No. 2,634,971. Each of the stuffers 100, 101 includes a plurality of hoppers which may be annually loaded with preprinted signatures. Each stuffer 100, 101 also includes an on-line hopper similar to hoppers 20, 21, 22, 23, so that the output of the press may be delivered to that hopper. In the system shown in FIG. 5, one press delivery, as indicated by the arrow 102, is conveyed through a squeeze roll arrangement 103 and then conveyed by a conveyor 104 to a suitable switch mechanism 105 which directs the signatures into a conveyor system 106. Associated with the conveyor 106 is a stream aligner 107 and a gap-maker 108. The signatures are then advanced toward the on-line hopper 100a of the stuffer 100, and as described above, will be directed downwardly into that hopper if the divert gate associated therewith is located so as to so divert the signatures. That divert gate would be so located if the call switch in the hopper 100a demands signatures. In the event, however, that there is no demand for signatures at the hopper 100a, the signatures would be conveyed outwardly and around the stuffer 101 by the conveyor system which includes conveying means generally designated 110 and to the 101a of the stuffer 101, and, of course, the hopper 101a is provided with a gap sensor and divert gate located thereat so as to divert the signatures downwardly into the hopper in the event of a need for signatures at that hopper. Any overflow from the output of that particular press may be directed through a switch mechanism 112 from the system. In this case, the output of the printing press 102a may be directed into both of the on-line hoppers of the stuffers 100, 101.

The system, however, is also constructed so that the output of a press 120, as indicated by the arrow 120a, may be directed into the system and through a switch mechanism or divert mechanism 121 into the conveyor arrangement for conveyance also to both of the hoppers 101a, 100a. In this case, the signatures from the press 120 are directed through a squeeze roller mechanism 122, then through the switch mechanism 121, and into the main conveyor system. The signatures are then traversed through a stream aligner 122a and a gap-maker 123. Of course, the gap-maker 123 and the stream aligner 122a are not operative when the system is operated or set so that the output of the press 102 is directed to both of the hoppers 100a, 100a. Of course, the gap-maker 123, if the system is set so that the output of the press 120 is directed to both of the hoppers 100a, 101a, the corner switch 112 is set so that the output of the press 120 is directed around and past the hopper 100a. Any overflow from such operation is directed by the switch 130 outwardly of the system.

While the system as shown in FIG. 5 may be set so that the output of either one of the presses 120, 102 may be directed to both of the on-line hoppers 100a, 101a, the system may also be set so that the output of the press 120 will be directed only to the hopper 101a with the switch 112 properly set so that the overflow will not be directed to the hopper 100a, but rather be directed to overflow. When the system is so set, the press 102a may also be operated so as to direct its output only to the hopper 100a, the overflow switch 130 may be set so as to direct the overflow from the press 102a out of the system. Accordingly, it should be clear that the system may be operated so that either press may direct its output to both of the hoppers, or the system may be operated or set so that both presses may operate simultaneously with the output of each press being associated or directed into one hopper only with the overflow from that press being directed out of the system.

Figure 6:
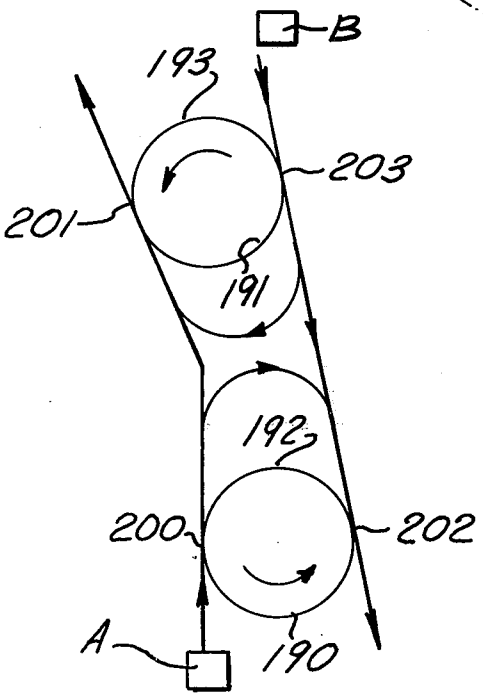
FIG. 6 is a still further schemtic view of another embodiment of the present invention.

FIG. 6 shows a further modification of the present invention in which the output from a particular press may be associated with four different stuffers. Again, the stuffers in this case are 180° sectors of a stuffer as shown in U.S. Pat. No. 2,634,971. In the embodiment of FIG. 6, the output from a given press A, as indicated by the arrows in the drawing, may be delivered to a hopper at 200 of stuffer 190 and to a hopper 201 of the stuffer 191. Alternatively, the output of the press A may be delivered to the hopper 202 of the stuffer 192 instead of to the hopper 201. Accordingly, the output of the press A may be collated in the stuffers 190, 192 or may be collated in the stuffers 190, 191. Likewise, the press delivery from the second press B may be directed on-line into a hopper at 203 of the stuffer 193, and may be directed into the hopper 202 of the stuffer 192. Alternatively, the output of the press may be directed not only to the hopper 203, but also to the hopper 201.

While the above system is capable of a variety of different operations, it should be further apparent that the system can be used to combine two freshly printed products on-line if the stuffers 12–13 and 14–15 act as single stuffers rather than a pair.

In view of the foregoing, it should be apparent that applicant has provided a substantially new and improved system having substantial advantages over the art.

Having described the invention, what is claimed is:

1. A combined system of a plurality of printing presses and a plurality of collators for assembling a freshly printed signature with at least one preprinted signature and wherein each collator includes at least one hopper for receiving and storing said preprinted signatures and at least one on-line hopper for receiving said freshly printed signatures, a collating conveyor and means for feeding the signatures individually from each hopper to said collating conveyor for collating the signatures fed from each hopper, said system comprising a manifold conveying means for feeding signatures to each of said on-line hoppers, said manifold conveying means comprising a closed continuous conveyor system which extends adjacent to each of said on-line hoppers for deposit of signatures therefrom into said hoppers, conveying means for each of said printing presses for feeding freshly printed signatures to said manifold conveying means, switch means for diverting freshly printed signatures from each conveying means for each of said printing presses to said manifold conveying means, divert gate means associated with each on-line hopper for diverting freshly printed signatures from said manifold conveying means to said on-line hopper, and control means for actuating said manifold conveying means, said conveying means for each printing press, said switch means, and said divert gate means so that said combined system is capable of operation in a plurality of modes including each priting press respectively supplying signatures to one on-line hopper or each printing press supplying signatures to all of said on-line hoppers.

2. A combined system as claimed in claim 1 wherein said conveying means are positioned above said manifold conveying means.

3. A combined system as claimed in claim 1 wherein said manifold conveying means has means associated therewith for directing freshly printed signatures therefrom at a point between where adjacent printing presses feed freshly printed signatures to said manifold conveying means.

4. A combined system of a plurality of printing presses and a plurality of collators for assembling a freshly printed signature with at least one preprinted signature and wherein each collator includes at least one hopper for receiving and storing said preprinted signatures and at least one on-line hopper for receiving said freshly printed signatures, a collating conveyor and means for feeding the signatures individually from each hopper to said collating conveyor for collating the signatures fed from each hopper, said system comprising a manifold conveying means for feeding signatures to each of said on-line hoppers, said manifold conveying means comprising a closed continuous conveyor system which extends adjacent to each of said on-line hoppers for deposit of signatures therefrom into said hoppers, conveying means for each of said printing presses for feeding freshly printed signatures to said manifold conveying means, overflow means for diverting freshly printed signatures from said manifold conveying means at a point between where adjacent printing presses feed freshly printed signatures to said manifold conveying means for temporarily storing the signatures until required by said collators, divert gate means associated with each on-line hopper for diverting freshly printed signatures from said manifold conveying means to said on-line hopper, and control means for actuating said manifold conveying means, said conveying means for each printing press, said overflow means, and said divert gate means so that said combined system is capable of operation in a plurality of modes including each printing press respectively supplying signatures to one on-line hopper or each printing press supplying signatures to all of said on-line hoppers.

* * * * *